United States Patent [19]

Leistritz et al.

[11] 3,995,712

[45] Dec. 7, 1976

[54] MUFFLER

[75] Inventors: Hans Karl Leistritz, Kussaberg, Germany; Hans Thoma, Neuhausen am Rheinfall, Switzerland

[73] Assignee: SIG Schweizerische Industrie-Gesellschaft, Neuhausen am Rheinfall, Switzerland

[22] Filed: Aug. 30, 1974

[21] Appl. No.: 502,078

[30] Foreign Application Priority Data

Sept. 3, 1973 Germany ..... 2344351

[52] U.S. Cl. ..... 181/53; 181/36 A; 181/57; 181/66

[51] Int. Cl.[2] ..... F01N 1/08

[58] Field of Search ..... 181/36 A, 36 B, 47 R, 181/41, 46, 49, 53–54, 56–57, 60, 66

[56] References Cited

UNITED STATES PATENTS

| | | | |
|---|---|---|---|
| 1,403,614 | 1/1922 | Malsack | 181/53 |
| 2,938,593 | 5/1960 | Miller et al. | 181/46 |
| 3,113,635 | 12/1963 | Allen et al. | 181/46 |
| 3,287,900 | 11/1966 | Soltau | 181/56 |
| 3,394,411 | 7/1968 | Dahlof | 181/46 |
| 3,495,680 | 2/1970 | Willette | 181/36 B |

FOREIGN PATENTS OR APPLICATIONS

| | | | |
|---|---|---|---|
| 1,355,652 | 2/1964 | France | 181/53 |
| 45,124 | 3/1935 | France | 181/46 |
| 110,638 | 5/1899 | Germany | 181/46 |
| 566,634 | 4/1932 | Germany | 181/53 |
| 115,352 | 10/1926 | Switzerland | 181/46 |

*Primary Examiner*—L. T. Hix
*Assistant Examiner*—Vit W. Miska
*Attorney, Agent, or Firm*—Watson, Cole, Grindle & Watson

[57] ABSTRACT

A muffler for exhaust systems of internal combustion engines, pneumatic tools and the like, in which at least two parallel conduction channels are provided each having a conducting device for applying a torque about the channel axis for the entering partial flow of gas only along a short upstream initial section thereof, but is free of any components along the remainder of its length, the conduction channels being so arranged at their downstream ends that the partial flows of the gas come together from opposite directions and then flow together to a common outlet.

5 Claims, 7 Drawing Figures

FIG. Ia

MUFFLER

This invention relates to a muffler for exhaust systems of internal combustion engines, pneumatic tools or the like, and more particularly to such a muffler which has two parallel guide channels extending from its entrance, for the sound-carrying gas stream, in which a torque is applied to the partial flows of the gas.

In existing mufflers of this type provided for gasoline engines, several concentric guide channels are provided, and each has spiral labyrinths along its entire length, with varying pitch, decreasing in the direction of flow, such guide channels surrounding a component-free central guide channel, and all the channels being of a different length. Such an arrangement is designed to assure that the gases which enter the muffler as pulses will leave the muffler as a continuous gas stream. The drawback of such arrangement, however, is that the system is extremely expensive to construct and is of a relatively large size.

It is an object of the present invention to provide a muffler of the aforementioned type, in which the torque applied to the partial flows of the gas is used to smooth out the pulsating load pressures of the gas in such a manner that, in contrast to existing devices, a simpler and more compact design of the muffler is made possible, and is made suitable for a large number of uses, especially for the most varied types of work instruments operated pneumatically.

The presently designed muffler is characterized in that each guide channel has a conducting device which applies a torque about the channel axis for the entering partial flow of gas only in a short upstream initial section, but is free of any further components along the remainder of its length; and that the guide channels are so arranged and constructed at their upstream end, that the partial flows of the gas unite from opposite directions and then flow into a common outlet.

With such an arrangement it is possible to construct the muffler at low cost from simple and accordingly inexpensive elements in such a manner that it takes up little space. Despite this simple construction, an exceedingly good muffling operation is made possible while at the same time avoiding any uneconomical throttling of the direct current components of the gas stream, since two gas conducting channels are provided with an appropriate coordination of their dimensions to the sound generator. The good muffling effect is seen due to the fact that the torque applied to each of the partial flows of the gas, as well as the conduction of the partial flows in such a way that they unite, produces a reflection muffling favored by turbulence. In this connection, it has been found to be especially advantageous if, according to another feature of the invention, the conducting devices in the guide channels are such that they apply a torque to the two partial gas flows in opposite directions.

In a preferred embodiment of the invention, the guide channels are designed from pipe elements interconnected at their upstream ends with a common entrance pipe, the upstream end sections of these elements being coaxially arranged.

Other features and advantages of the invention will become more apparent from the following detailed description of the invention when considered in conjuntion with the accompanying drawings wherein:

FIG. 1A is a sectional view taken along line 1A—1A of FIG. 1;

FIGS. 3 to 6 schematically show other embodiments of the invention at a reduced scale.

Figure 1:
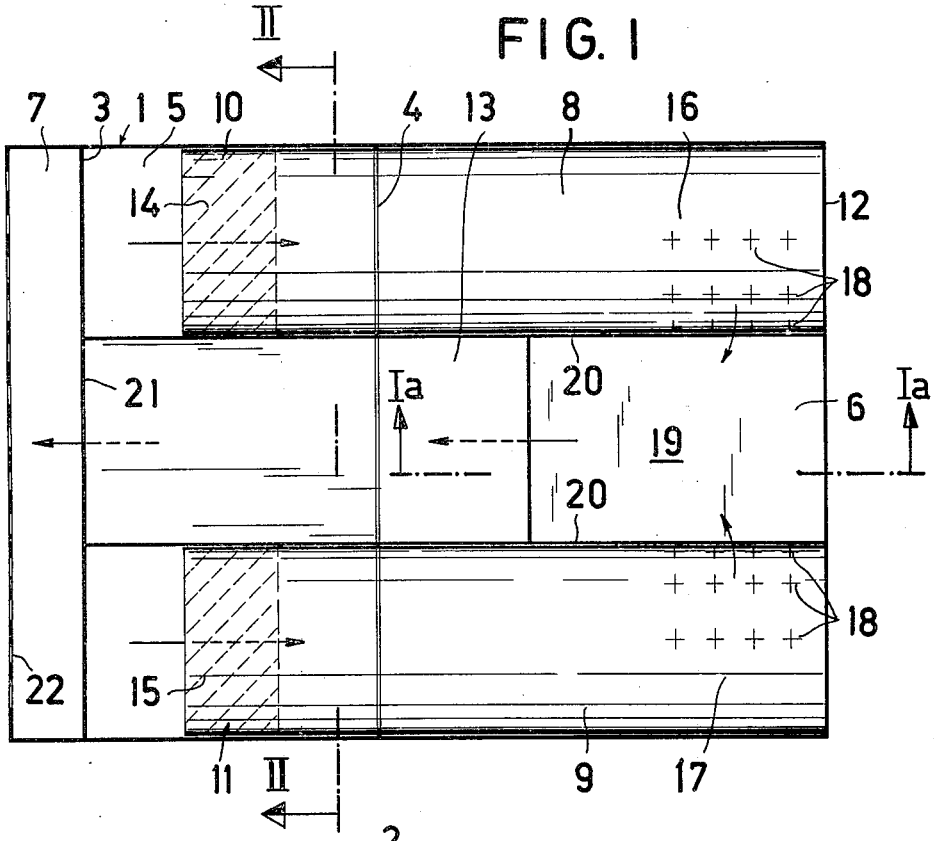
FIG. 1 is a schematic top view of the interior of the muffler according to the invention.
Figure 1:
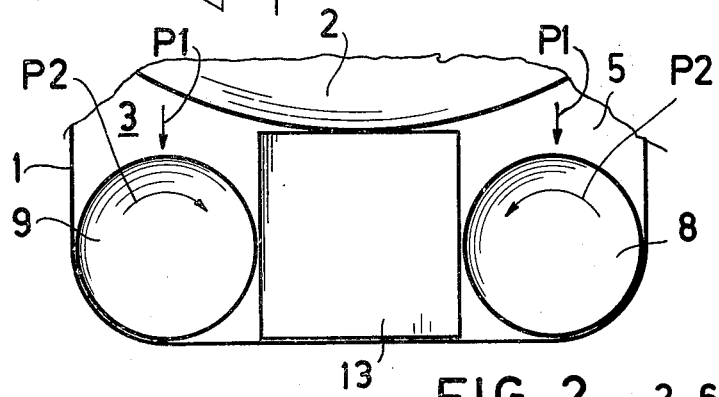
Figure 2:
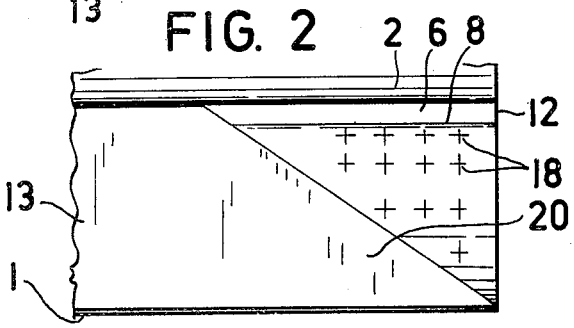
FIG. 2 is a schematic sectional view taken along line 2—2 of FIG. 1.

The muffler shown in FIGS. 1 and 2, which may be constructed completely of thin-walled sheet metal, has a casing 1 to facilitate mounting of the muffler directly onto a sound generator as, for example, an outer liner or wall 2 of a pneumatic instrument (see FIG 2). Two partitions 3 and 4 are provided in casing 1 and define three adjacent chambers 5, 6 and 7. Middle chamber 5 serves as an entrance chamber for the sound-carrying gas flow, which gas enters into this chamber in the direction of arrows $P_1$ (See FIG. 2). Two parallel cylindrical pipes 8 and 9 extend downstream from entrance chamber 5 to form separate as conducting channels, these pipes extending in a longitudinal direction of the casing through partition 4 and into chamber 6. The upstream sections 10 and 11 of pipes 8 and 9, located in entrance chamber 5, are open in an axial direction for the entrance of the gas, while the downstream ends of the pipes located in chamber 6 are closed off by a casing end wall 12. A square pipe 13 is located between cylindrical pipes 8 and 9 and extends from chamber 6 in a longitudinal direction through partition 4 and entrance chamber 5 to partition 3, where pipe 13 opens into chamber 7.

Conducting devices 14 and 15 are respectively provided at the entrance opening of each cylindrical pipe 8 and 9, each such device extending along a short axial section of the pipe and being designed in such a manner that it applies a torque or a spinning motion about the axis of the pipe for the entering partial flow of the gas. Conducting devices 14 and 15, which are not shown separately in FIG. 1 but are indicated by a shaded section, can be, for example, spiral or helical conducting surfaces or a circle of appropriately designed blades. Conducting devices 14 and 15 in pipes 8 and 9 are so constructed according to the invention that the partial flows of the gas are given a torque in opposite directions within the two pipes, as indicated in FIG. 2 by the arrows $P_2$. The sections of the two pipes 8 and 9 that connect with conducting devices 14 and 15 have no additional components throughout their length.

As further shown in FIG. 1, pipes 8 and 9 have downstream axial end sections 16 and 17 of a certain length which have openings or holes 18 on the peripheral sides thereof which face each other, such holes being indicated in FIG. 1 by crosses. The partial flows of the gas pass out of the pipes through holes 18 into chamber 6 which therefore serves as a collecting chamber. An entrance opening 19 of pipe 13 is located between end sections 16 and 17, and forms a gas drainage channel. Entrance opening 19 is defined by side walls 20 of pipe 13 which are inclined upwardly in an upstream direction (see FIG. 1A), thereby assuming an essentially shovel-like form.

An exit opening 21 is provided in partition wall 3 through which pipe 13 empties into outlet chamber 7. A casing end wall 22 forms an upstream end of chamber 7, such end wall having holes therein as shown in FIG. 1. It is found advantageous, especially for a muffler intended for pneumatic instruments, for the distance of casing end wall 22 from exit opening 21 to be smaller than the greatest width, i.e., the diagonal of the square pipe 13. The holes of casing end wall 22 should be designed so that the total hole area in the casing end wall facing exit opening 21 and corresponding to it in area, is less than half the cross-sectional area of pipe 13. The sum of the hole areas in the entire casing end wall 22 should, however, be greater than 1½ times the cross-sectional area of pipe 13.

With the presently designed muffler, the spinning motion applied initially to each partial flow of the gas approaches a turbulence in the downstream end section of the conduction channels 8 and 9, from which the gas exits through the sides thereof. The casing end wall 12 which closes off the conducting channels serves as a reflector for the partial flow. In collecting chamber 6 located between the end sections of cylindrical pipes 8 and 9, there is also turbulence as the result of the intermixing of the gas streams issuing from holes 18 of the pipes. The turbulences support the muffling effect achieved by the cylindrical hollow chambers and the collection chamber connected to it, thereby acting as a relaxation chamber, such muffling effect being based on a reflection. It is to be understood that the dimensions of the cylindrical pipes and the collection chamber are coordinated, depending upon the purpose of the muffler, with the frequencies to be muffled.

The gas stream, which enters pulsatingly into casing entrance chamber 5, leaves casing collecting chamber 6 through pipe 13, serving as a gas drainage channel, essentially in a continuous form. The arrangement of pipe 13 defining a gas drainage channel between pipes 8 and 9 leading in the partial flows of the gas, makes it possible to achieve a highly compact design of the muffler as shown in FIGS. 1 and 2. The design of the third pipe 13 as a streamlined-section tube, which has a square cross-section in the example shown, further assures a relatively large current cross-section, so that the gas can flow out of the casing collecting chamber without throttling. Also, the streamlined-section tube is rigid, which has proven advantageous for the mounting of the muffler, e.g., on the outer liner or wall of a pneumatic tool.

As aforedescribed, casing outlet chamber 7, into which gas drainage channel 13 empties, also serves as a relaxation chamber for the gas and contributes to the muffling by reflection as a result of the holes in casing end wall 22.

The embodiment shown in FIGS. 1 and 2 represents a compact and highty effective muffler, which assures a smoothing out of the gas pulsating load pressures contained in the sound-carrying gas stream, without any capacity-reducing throttling of the direct current.

FIGS. 3 through 6 diagrammatically illustrate other embodiments of the muffler according to the invention. In each of these embodiments, two parallel pipes 28 and 29 form gas conduction channels which are preferably of cylindrical cross-section, and are interconnected at their upstream ends with a common entrance pipe 32. Sections 30 and 31 of the respective pipes, adjacent entrance pipe 32, respectively contain essentially spiral conducting devices 34 and 35. Each such conducting device is designed to apply torque in opposite directions, as shown by the arrows in FIGS. 3 to 6, to the partial flows of gas through pipes 28 and 29. The downstream end sections of pipes 28 and 29 in each of these embodiments are arranged coaxially.

Figure 3:
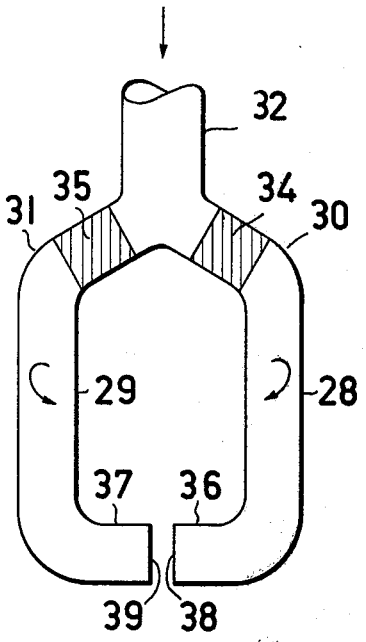
Figure 6:
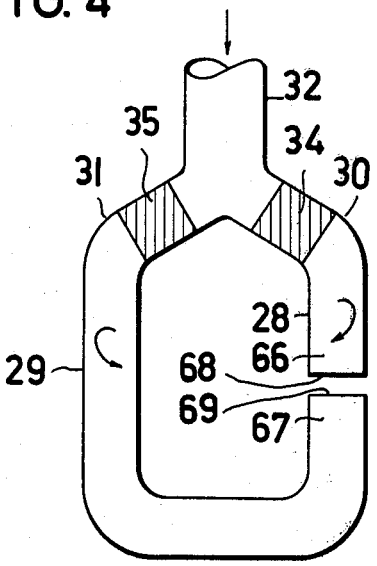

As shown, in the embodiments of FIGS. 3 and 6 differ only with respect to the design of the coaxial end sections of the pipes. In FIG. 3, coaxial end sections 36 and 37 of the pipes have coaxial exit openings 38 and 39 facing each other at a slight distance apart, through which the partial gas flows empty into a common outlet or an outlet chamber (not shown) of the muffler. Such an outlet chamber encompasses at least the end sections of the pipes and forms a flash chamber.

Figure 4:
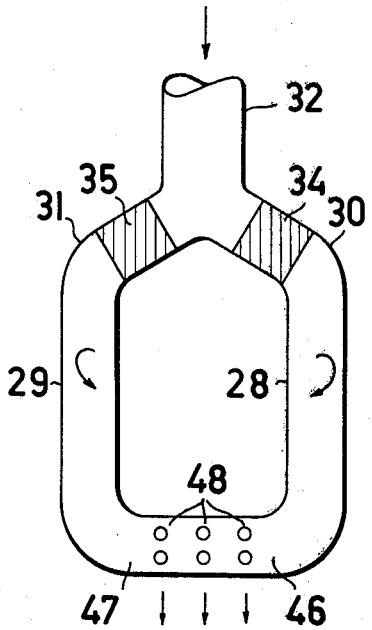

In FIG. 4, the coaxial end sections 46 and 47 of the pipes are connected to each other and have through openings 48 in the connection area through which the partial gas flows empty into a common outlet or into an outlet chamber.

Figure 5:
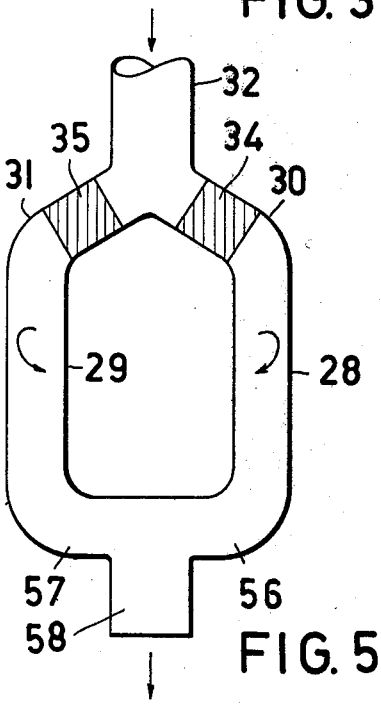

In FIG. 5, the coaxial end sections 56 and 57 of the pipes are interconnected with a common outlet reducing pipe 58, which essentially extends perpendicularly to the axis of the end sections and coaxially with entrance pipe 32 of the end sections.

The embodiment of FIG. 6 differs from that of FIG. 3 in that the component-free sections of pipes 28 and 29 conducting the partial flows of the gas are of different lengths. The coaxial end sections 66 and 67 of the pipes have open ends 68 and 69, similarly as in FIG 3, which are spaced apart a slight distance through which the gas flows into a common outlet or into an outlet chamber of the muffler.

As in the FIGS. 1 and 2 embodiments described above, a turbulence is effected in the downstream end sections of the pipes in the FIGS. 3 through 6 embodiments as well, as the result of the torque applied in opposite directions to the partial flows of gas in the pipes. Since the end sections of the pipes are coaxially arranged and thus the partial flows of the gas from each pipe can enter into the opposite pipe through its open end, the muffling effected by reflection within the two pipes is further improved.

For a muffler intended for pneumatic instruments or the like, it has been found to be especially advantageous for the end edges of the walls of all the pipes at the entrance side in a flow direction, and those of the conducting devices, to be tapered to some degree. This reduces the current resistance and prevents ice formation at low temperatures, to which pneumatic tools are especially susceptible. For such purpose, all the individual components of the muffler, insofar as the intended use allows it, can be made entirely of plastic, rubber or the like, or, if other materials are used, can be coated on the inside with plastic, rubber or the like. These measures produce an advantageous effect of the muffling. Finally, the sound-generating conducting devices can be so designed and installed that they vibrate while operating, which can be achieved, for example, by fastening only one side of the conducting device or by means of an appropriate selection of materials.

It is to be understood that the various embodiments described herein can be modified, especially with respect to the design and arrangement of the gas conducting channels, without departing from the spirit of the invention.

Obviously, many other modifications and variations of the invention are made possible in the light of the above teachings. It is therefore to be understood that within the scope of the appended claims the invention may be practiced otherwise than as specifically described.

What is claimed is:

1. A muffler for an exhaust system of an internal combustion engine, a pneumatic tool and the like, comprising a casing containing at least two spaced parallel conduction channels comprising pipe elements extending in a downstream direction from an entrance chamber provided in said casing for the sound-carrying gas stream of the exhaust system, each said channel having a conducting device mounted therein adjacent said entrance chamber and extending a short distance downstream of said channels, each said device having means for applying a torque to the partial flow of the entering gas about the longitudinal axis of each said channel, each said channel being free of any components along the remainder of its length, and a separate gas collecting chamber in said casing located between said pipe elements at their downstream ends, means closing said pipe elements at said downstream ends, and means adjacent said ends comprising through openings in said pipe elements and facing each other and opening into the gas collecting chamber to permit the partial gas flows therein to unite from opposite directions and to thereafter flow together into a common outlet chamber provided for the system, a third pipe element being located between said conduction channels, said third pipe extending through said entrance chamber and opening into said collecting chamber and an outlet chamber respectively at its opposite ends for draining the united partial gas flows from said collecting chamber.

2. The muffler according to claim 1, wherein said outlet chamber is defined by a perforated casing wall spaced upstream from said end of said third pipe which opens into said outlet chamber, said casing wall spacing being less than the largest cross-sectional dimension of said third pipe, and the total hole area of said perforated casing wall within the cross-sectional area of said third pipe is less than half said cross-sectional area, while the total hole area of said perforated casing wall is more than 1½ times the cross-sectional area of said third pipe.

3. The muffler according to claim 1, wherein the end edges of each of said pipes on the entrance side in a flow direction of the gas are tapered.

4. The muffler according to claim 1, wherein said pipes are of a non-metallic material.

5. The muffler according to claim 1, wherein said pipes are of a metallic material coated with non-metallic material.

* * * * *